US006719221B2

(12) United States Patent
Klügl et al.

(10) Patent No.: US 6,719,221 B2
(45) Date of Patent: Apr. 13, 2004

(54) FUEL INJECTOR

(75) Inventors: Wendelin Klügl, Seubersdorf (DE); Günter Lewentz, Regensburg (DE); Gerd Schmutzler, Kareth (DE); Andreas Voigt, Regensburg (DE)

(73) Assignee: Siemens Aktiengesellschaft, Munich (DE)

( * ) Notice: Subject to any disclaimer, the term of this patent is extended or adjusted under 35 U.S.C. 154(b) by 197 days.

(21) Appl. No.: 10/093,907

(22) Filed: Mar. 8, 2002

(65) Prior Publication Data

US 2002/0162905 A1 Nov. 7, 2002

(30) Foreign Application Priority Data

May 3, 2001 (DE) ..... 101 21 531

(51) Int. Cl.[7] ..... F02M 59/00; F02M 39/00; B05B 12/14; B05B 1/00

(52) U.S. Cl. ..... 239/533.3; 239/533.2; 239/600; 239/127; 239/89

(58) Field of Search ..... 239/88, 89, 90, 239/91, 92, 96, 124, 127, 533.2, 533.3, 533.8, 533.9, 533.11, 585.1–585.5, 600; 251/129.15, 129.21, 127

(56) References Cited

U.S. PATENT DOCUMENTS 4,005,826 A * 2/1977 Woodward ..... 239/533.8
4,249,499 A * 2/1981 Perr ..... 123/502
4,280,659 A * 7/1981 Gaal et al. ..... 239/124
4,540,122 A * 9/1985 Teerman ..... 239/88
4,674,688 A * 6/1987 Kanesaka ..... 239/533.8
5,553,781 A * 9/1996 Barkhimer et al. ..... 239/88

FOREIGN PATENT DOCUMENTS

WO WO 00/60233 10/2000

* cited by examiner

*Primary Examiner*—Davis Hwu
(74) *Attorney, Agent, or Firm*—Laurence A. Greenberg; Werner H. Stemer; Ralph E. Locher

(57) ABSTRACT

The fuel injector has a housing that is formed from at least one nozzle tension nut, a first injector module and a second injector module. The first injector module and the second injector module adjoin one another and are disposed in the nozzle tension nut. A fuel high-pressure bore is led through the first injector module and the second injector module. A fuel return bore is disposed in the housing. Contact surfaces between the injector modules form a first gap that adjoins the high-pressure bore. Contact surfaces between the nozzle tension nut and the injector modules form a second gap that is connected to the first gap. The return line adjoins the second gap for the discharge of fuel that has entered the second gap from the high-pressure bore via the first gap. The fuel injector is such that the second gap is sealed off relative to the surroundings of the fuel injector.

4 Claims, 3 Drawing Sheets

FUEL INJECTOR

BACKGROUND OF THE INVENTION

1. Field of the Invention

The invention relates to a fuel injector.

By use of a fuel injector, metered quantities of fuel are injected into a combustion space of an internal combustion engine. In future common-rail injection systems, the fuel is to be injected at a pressure of well above 1000 bar, and therefore the aim is to configure fuel injectors so as to be particularly suited to high pressures.

International Patent Disclosure WO 00/60233 discloses a fuel injector that has a first injector module and an adjoining second injector module. The injector modules are disposed in a nozzle tension nut. A high-pressure bore is led through the injector modules. So that, because of the high pressure in the high-pressure bore, no fuel emerges through the gaps formed by contact surfaces between the injector modules into the gaps formed by contact surfaces between the nozzle tension nut and the injector modules and leaks from there into the surroundings of the fuel injector. The injector modules are pressed onto one another with a high axial prestressing force by the nozzle tension nut.

The surface pressure is particularly high, since at least one of the contact surfaces has an elevated part surface in the outer region, so that the entire prestressing force acts only on the part surface. The elevated part surface prevents the fuel from emerging into the gap formed by contact surfaces between the nozzle tension nut and the injector modules. Located in the inner region of the contact surface is a sunken part surface that is connected to a return bore for the discharge of fuel emerging from the high-pressure bore.

In order to seal off the fuel injector by the measures described, very high prestressing forces are necessary. The height of the permissible prestressing forces is limited, however, by the material strength of the nozzle tension nut and of the injector modules. Prestressing forces that are too high may lead to material damage or operating faults of the fuel injector. Thus, components lying in the force flux and having narrow guide clearances, such as, for example, the nozzle needle and control piston, could jam.

SUMMARY OF THE INVENTION

It is accordingly an object of the invention to provide a fuel injector which overcomes the above-mentioned disadvantages of the prior art devices of this general type, which has higher high-pressure tightness along with lower prestressing forces.

With the foregoing and other objects in view there is provided, in accordance with the invention, a fuel injector. The fuel injector contains a housing having at least one return bore. The housing includes at least one nozzle tension nut with a nut contact surface, a first injector module having a first contact surface, and a second injector module having a second contact surface. The first injector module and the second injector module adjoin one another and are disposed in the nozzle tension nut. The first injection module and the second injector module have at least one high-pressure bore leading through the first injection module and the second injector module for conducting fuel. The first contact surface and the second contact surface have a first space formed there-between defining a first gap adjoining the high-pressure bore. The nut contact surface and the first contact surface have a second space formed there-between, and the nut contact surface and the second contact surface have a third space formed there-between. The second space and the third space together define a second gap connected to the first gap. The second gap is sealed off relative to surroundings of the fuel injector. The return line adjoins the second gap for discharging the fuel that has entered the second gap from the high-pressure bore through the first gap.

There is therefore no attempt to prevent completely the leakage of fuel out of the first gap. Instead, a leakage out of the second gap is prevented, in that the second gap is sealed off relative to the surroundings of the fuel injector and pressure is prevented from building up in the second gap with the aid of the return bore.

Since high-pressure tightness is achieved not solely by the injector modules being pressed onto one another, the prestressing force with which the injector modules are pressed against one another can be within a range which is harmless to the material strength of the injector modules and of the nozzle tension nut.

The high high-pressure tightness is achieved without any enlargement of the construction space.

The second gap can be sealed off, for example, with the aid of an O-ring seal. The O-ring seal is disposed, for example, between the nozzle tension nut and the first injector module.

A screw connection coated, for example, with Teflon may also be used for sealing off the second gap. Particularly good sealing off can be achieved by the screw connection being coated with a microencapsulated adhesive or sealant. During screwing, the capsules break open and release the adhesive or sealant.

Surface pressure may also contribute to sealing off the second gap. For example, the nozzle tension nut has a projection, against which an injector module is pressed with an axial prestressing force.

The return bore may be formed at least of a main bore and of an adjoining relief bore, the main bore running essentially perpendicularly to the contact surfaces between the injector modules, and the relief bore emerging laterally from the second injector module into the second gap.

Since a groove can be produced more simply in comparison with a bore, it is advantageous if the return bore is formed at least of a main bore and of an adjoining relief groove, the main bore running essentially perpendicularly to the contact surfaces between the injector modules, and the relief groove being introduced onto at least one of the contact surfaces between the injector modules, in such a way that the relief groove adjoins the second gap.

It is within the scope of the invention to provide further injector modules, through which the high-pressure bore is led and which are disposed in the nozzle tension nut. In this case, too, leakage through gaps formed at the contact surfaces between the injector modules is not critical, since the gaps, like the first gap, issue into the second gap that is sealed off relative to the surroundings of the fuel injector and is connected to the return line.

Other features which are considered as characteristic for the invention are set forth in the appended claims.

Although the invention is illustrated and described herein as embodied in a fuel injector, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
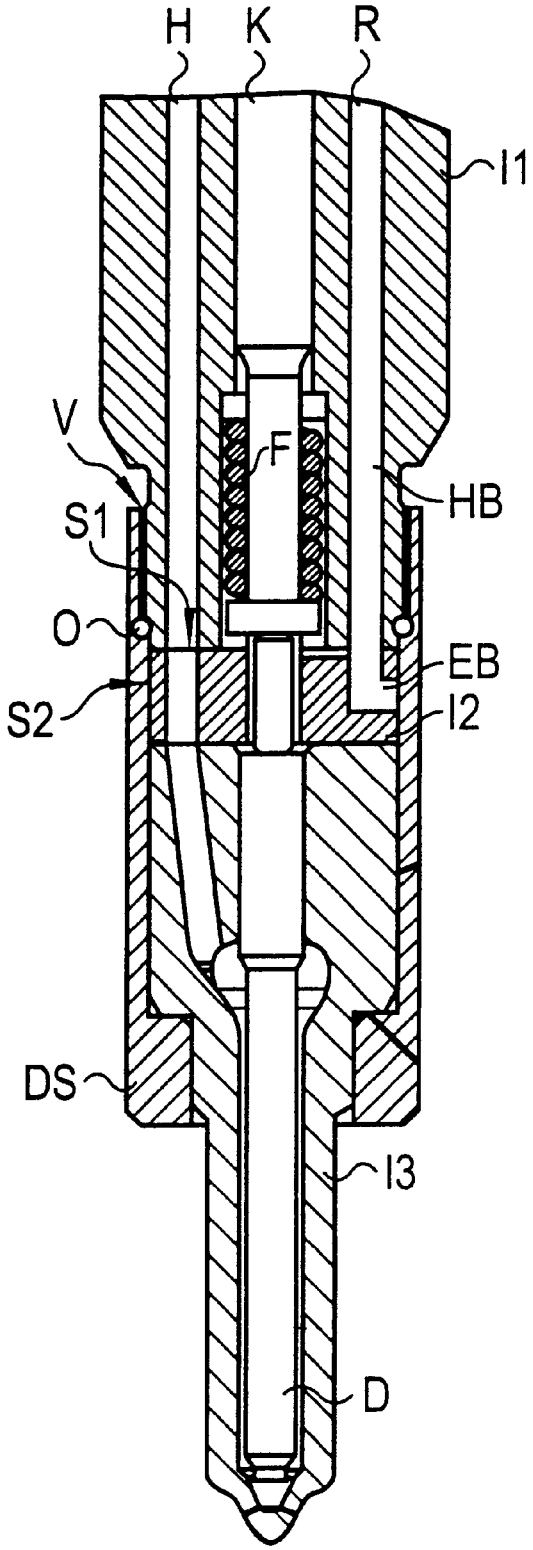
FIG. 1 is a diagrammatic, cross-sectional view through a lower part of a fuel injector with a first injector module, a second injector module, a third injector module, a high-pressure bore, a return bore, a screw connection, an O-ring seal, a nozzle tension nut, a nozzle needle, a piston and a spring according to the invention.

Referring now to the figures of the drawing in detail and first, particularly, to FIG. 1 thereof, there is shown in a first exemplary embodiment, a first fuel injector is provided, with a housing, in which a nozzle needle D, a piston K, a high-pressure bore H, a return bore R and a spring F are disposed. The high-pressure bore H is connected to the nozzle needle D in such a way that, with the piston K is raised, the nozzle needle D is pressed upward by virtue of the pressure of the fuel in the high-pressure bore. The piston K is actuated by a non-illustrated actuator-controlled servo-valve. The return line R is connected to a chamber, in which the piston K and the restoring spring F are disposed.

The housing is formed, inter alia, of a first injector module I1, a second injector module I2, a third injector module I3 and a nozzle tension nut DS. The injector modules I1, I2, I3 are disposed one above the other and in the nozzle tension nut DS (see FIG. 1). The injector modules I1, I2, I3 are pressed against one another with a prestressing force by the nozzle tension nut DS.

The high-pressure bore H is led through all three injector modules I1, I2, I3. The return bore R is led through the first injector module Ii and reaches into the second injector module I2.

The nozzle tension nut DS is connected to the first injector module I1 by a screw connection V. The screw connection V is coated with Teflon.

An O-ring seal O is provided below the screw connection V.

The nozzle tension nut DS has, in the region of the nozzle needle D, an inwardly protruding projection, against which the third injector module I3 is pressed axially.

Contact surfaces between the first injector module I1 and the second injector module I2 form a first gap S1. The same applies correspondingly to contact surfaces between the second injector module I2 and the third injector module I3. The first gap S1 is connected to a second gap S2 that is formed by contact surfaces between the nozzle tension nut DS and the injector modules I1, I2, I3.

The second gap S2 is sealed off relative to the surroundings of the fuel injector by the screw connection V, the O-ring seal O and a surface pressure at a projection of the nozzle tension nut DS.

The return bore R is formed of a main bore HB and of an adjoining relief bore EB. The main bore HB runs essentially perpendicularly to the contact surfaces between the first injector module I1 and the second injector module I2. The relief bore EB emerges laterally from the second injector module I2 and issues into the second gap S2.

Fuel which emerges from the high-pressure bore H into the first gap S1 or into the gap between the second injector module and the third injector module and from there into the second gap S2 is discharged via the relief bore EB. This avoids the situation where a pressure builds up in the second gap S2 and, despite measures for sealing off the second gap S2, could lead to a leakage into the surroundings of the fuel injector occurring.

Figure 2:
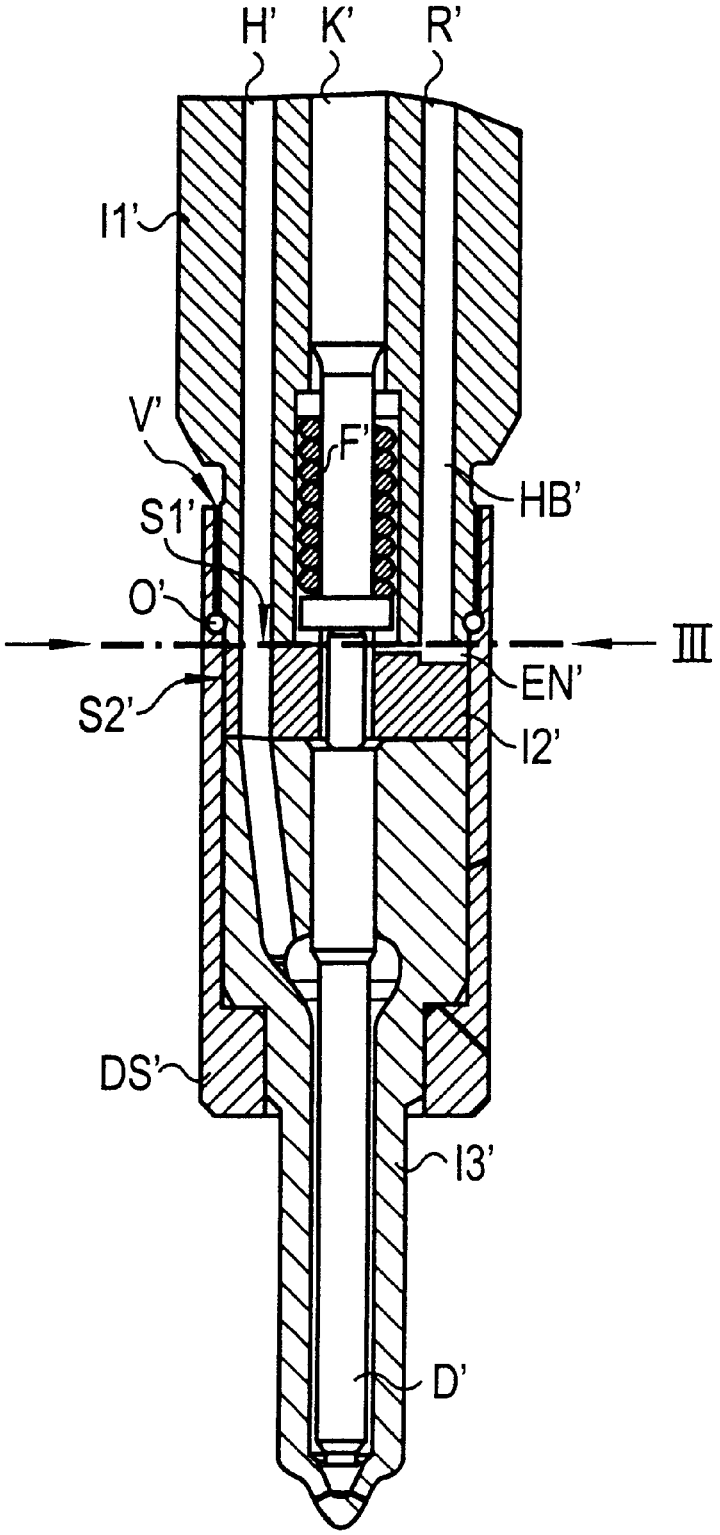
FIG. 2 is a cross-sectional view through a lower part of a second fuel injector having the first injector module, the second injector module, the third injector module, the high-pressure bore, the return bore, the screw connection, the O-ring seal, the nozzle tension nut, the nozzle needle, the piston and the spring.

In a second exemplary embodiment shown in FIG. 2, a second fuel injector is provided, which, like the first fuel injector, has a high-pressure bore H', a piston K', a screw connection V', an O-ring seal O', a return bore R', a spring F', a nozzle tension nut DS', a first injector module I1', a second injector module I2', a third injector module I3', a first gap S1', a second gap S2' and a nozzle needle D'.

Figure 3:
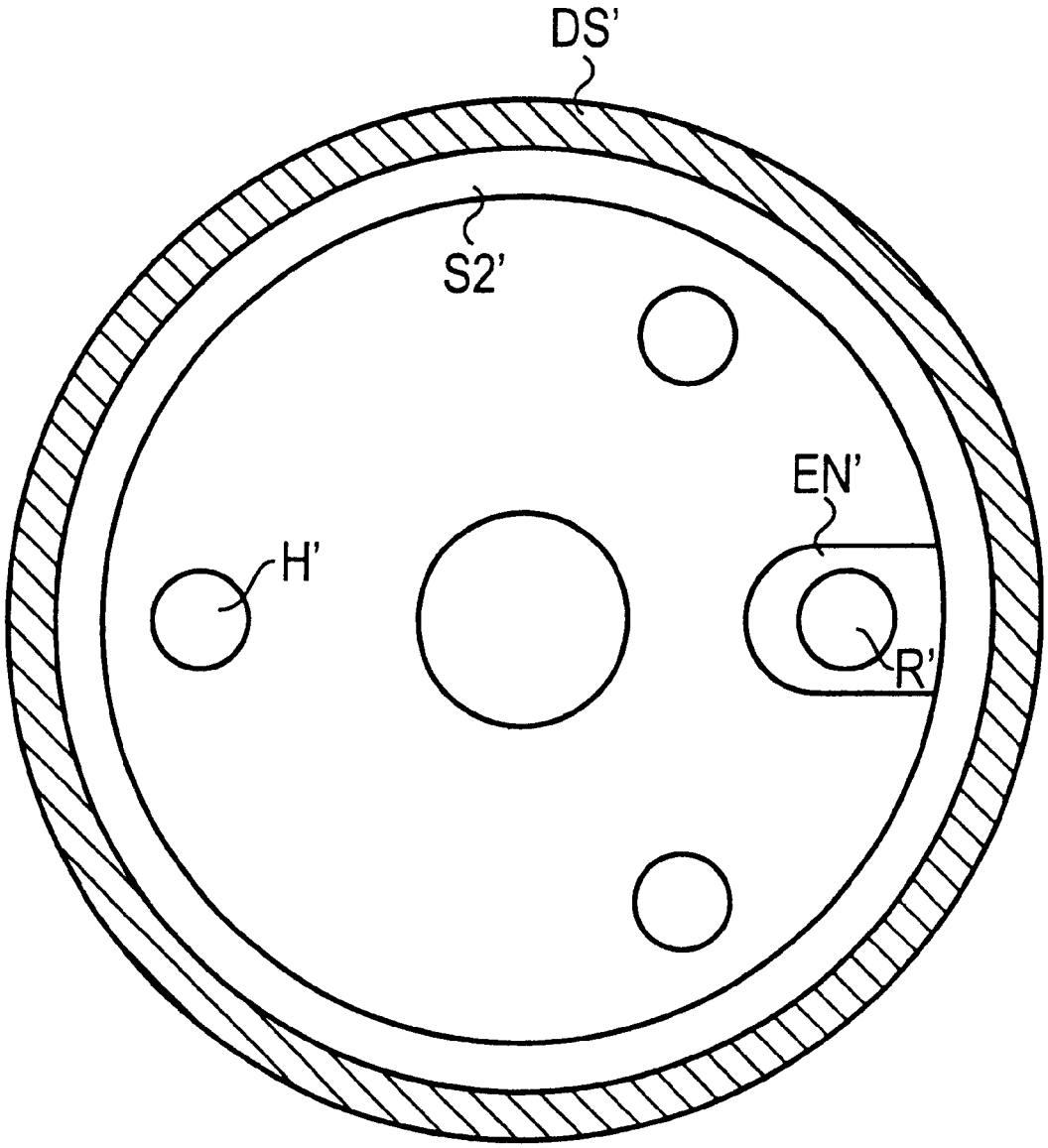
FIG. 3 is a cross-sectional view, perpendicular to the cross section from FIG. 2, through the second fuel injector.

In contrast to the first exemplary embodiment, the return bore R' has a relief groove EN' instead of a relief bore EB. The relief groove EN' is introduced in the contact surface of the second injector module I2' which faces the first injector module I1'. The relief groove EN' adjoins the second gap S2' (see FIGS. 2 and 3).

We claim:

1. A fuel injector, comprising:

a housing having at least one return bore formed therein, said housing containing:

at least one nozzle tension nut with a nut contact surface;

a first injector module having a first contact surface; and a second injector module having a second contact surface, said first injector module and said second injector module adjoin one another and are disposed in said nozzle tension nut, said first injection module and said second injector module having at least one high-pressure bore formed therein leading through said first injection module and said second injector module for conducting fuel;

said first contact surface and said second contact surface having a first space formed there-between defining a first gap adjoining said high-pressure bore;

said nut contact surface and said first contact surface having a second space formed there-between, said nut contact surface and said second contact surface having a third space formed there-between, said second space and said third space together defining a second gap connected to said first gap, said second gap being sealed off relative to surroundings of the fuel injector;

said return line adjoining said second gap for discharging the fuel that has entered said second gap from said high-pressure bore through said first gap.

2. The fuel injector according to claim 1, further comprising at least one of an O-ring seal, a screw connection coated with a sealing material, and a surface pressure for sealing off said second gap relative to the surroundings of the fuel injector.

3. The fuel injector according to claim 1, wherein:

said return bore includes at least one main bore and an adjoining relief bore;

said main bore runs substantially perpendicularly to said first contact surface and to said second contact surface; and said relief bore emerges laterally from said second injector module into said second gap.

4. The fuel injector according to claim 1, wherein:

said return bore includes at least a main bore and an adjoining relief groove;

said main bore runs substantially perpendicularly to said first contact surface and to said second contact surface; and said relief groove being introduced into at least one of said first contact surface and said second contact in such a way that said relief groove adjoins said second gap.

* * * * *